United States Patent [19]

Hurly

[11] Patent Number: 5,045,280

[45] Date of Patent: Sep. 3, 1991

[54] INTERMETALLIC COMPOUNDS

[75] Inventor: Janice Hurly, Transvaal Province, South Africa

[73] Assignee: Mintek, South Africa

[21] Appl. No.: 589,509

[22] Filed: Sep. 28, 1990

[30] Foreign Application Priority Data

Oct. 4, 1989 [ZA] South Africa ..... 89/7529

[51] Int. Cl.[5] ..... C22C 5/04

[52] U.S. Cl. ..... 420/466

[58] Field of Search ..... 420/466

[56] References Cited

U.S. PATENT DOCUMENTS 4,165,983 8/1979 Bourne et al. ..... 75/172 R

OTHER PUBLICATIONS

E. M. Wise, "Chapter XV: The Platinum Metals," Reprint from Modern Uses of Nonferrous Metals, 2nd Ed, 1953, pp. 315–317.

*Primary Examiner*—Paul J. Killos
*Assistant Examiner*—Porfirio Nazario
*Attorney, Agent, or Firm*—Mason, Fenwick & Lawrence

[57] ABSTRACT

Intermetallic compounds are disclosed in which a platinum/aluminium compound includes copper in proportions chosen to provide desirable color, from yellow through orange to copper/red, to the compound. The compound contains from 50 to 81, preferably 57 to 80% by weight platinum; from 5 to 30, preferably 12.5 to 30% by weight aluminium; and from 1 to 47.5 and preferably 5 to 30% by weight copper.

9 Claims, 7 Drawing Sheets

INTERMETALLIC COMPOUNDS

FIELD OF THE INVENTION

This invention relates to intermetallic compounds and, more specifically, to intermetallic compounds of platinum and aluminium.

Still more particularly the invention is concerned with the modification of the colour of platinum-/aluminium intermetallic compounds to provide aesthetically appealing colours to such compounds to render them appealing for use in the jewellery trade.

BACKGROUND TO THE INVENTION

Platinum itself has a rather plain silver colour and, in consequence, is not considered to be particularly appealing for use in the jewellery trade. On the other hand, certain platinum intermetallic compounds, particularly those with aluminium, do have colours different from that of the constituent metals and, in particular, the intermetallic compound $PtAl_2$ has a bright yellow colour.

However, such a colour does not necessarily render platinum, in this form, attractive for use in the jewellery trade as the yellow colour is not particularly distinctive over and above that of various gold alloys which are substantially more easy to work and form into jewellery whereas the platinum/aluminium intermetallic compounds are hard and brittle and not easy to form into attractive parts of articles of jewellery.

Some attention has been given to intermatallic compounds, that provide colour. Attention has thus been given in a number of publications to intermetallic compounds of gold and aluminium.

Regarding the physical properties of intermetallic compounds, European Patent Application No. 87810140 claims to provide an expedient for obtaining more workable intermetallic compounds from a physical point of view. This patent specification embraces an enormous range of possible compounds, both with and without precious metals. It fails, however, to teach any particularly useful platinum based compounds from a colour point of view.

It is the object of this invention to provide intermetallic compounds of platinum and aluminium which have the colour thereof modified to render them more attractive and aesthetically appealing for use as component parts of articles of jewellery.

SUMMARY OF THE INVENTION

In accordance with this invention there is provided an intermetallic compound of platinum and aluminium comprising:

(i) from 50 to 81 weight per cent platinum;

(ii) from 5 to 30 weight per cent of aluminium; and, (iii) from 1 to 47 5 weight per cent copper.

Further features of the invention provide for the intermetallic compound to comprise:

(i) from 57 to 80 per cent by weight platinum;

(ii) from 12.5 to 30 per cent by weight aluminium; and, (iii) from 5 to 30 per cent by weight copper;

and for the intermetallic compound to be made either by adding copper in the appropriate quantity to the preformed intermetallic compound $PtAl_2$, or, by simply melting together the required quantities of the three pure metal constituents.

It has been found that various different colours of the intermetallic compounds result from differing additions of copper. Thus, for example, an addition of 10 weight per cent of copper to a $PtA1_2$ intermetallic compound results in the colour being changed to an orange colour. Additions of 20% and 25% cause the intermetallic compound to assume a pinkish/mauve shade.

In general it has been found, and is a feature of the invention, that the following ranges of compositions have the general colour stated:

| | |
|---|---|
| Yellow compounds: | |
| Platinum | 70 to 77 weight % |
| Aluminium | 20 to 23 weight % |
| Copper | 1 to 8 weight % |
| Orange compounds: | |
| Platinum | 63 to 70 weight % |
| Aluminium | 18 to 21 weight % |
| Copper | 8 to 15 weight % |
| Copper-red compounds: | |
| Platimum | 54 to 62 weight % |
| Aluminium | 15 to 20 weight % |
| Copper | 20 to 30 weight % |

The invention still further provides that the preferred compositions of the intermetallic compound be chosen such that the chromaticity (Yxy) when measured using a standard CIE source C illuminent, and a standard observer angle of 2° has an "x" value and a "y" value in respect of intermetallic compound samples polished to a lum mirror finish that provide a percentage colour of at least 9,8. Most preferably, the "x" value is at least 0,34 and the "y" value is at least 0,33.

The modified intermetallic compounds provided by this invention can be made in any suitable manner such as, conveniently, by heating the constituents under an inert atmosphere, in particular argon, in a suitable ar furnace.

In order that the invention may be more fully understood, various experimental results and a discussion thereof are set out below with reference to the accompanying drawings.

DETAILED DESCRIPTION OF EXPERIMENTAL COMPOUNDS PRODUCED

Figure 1:
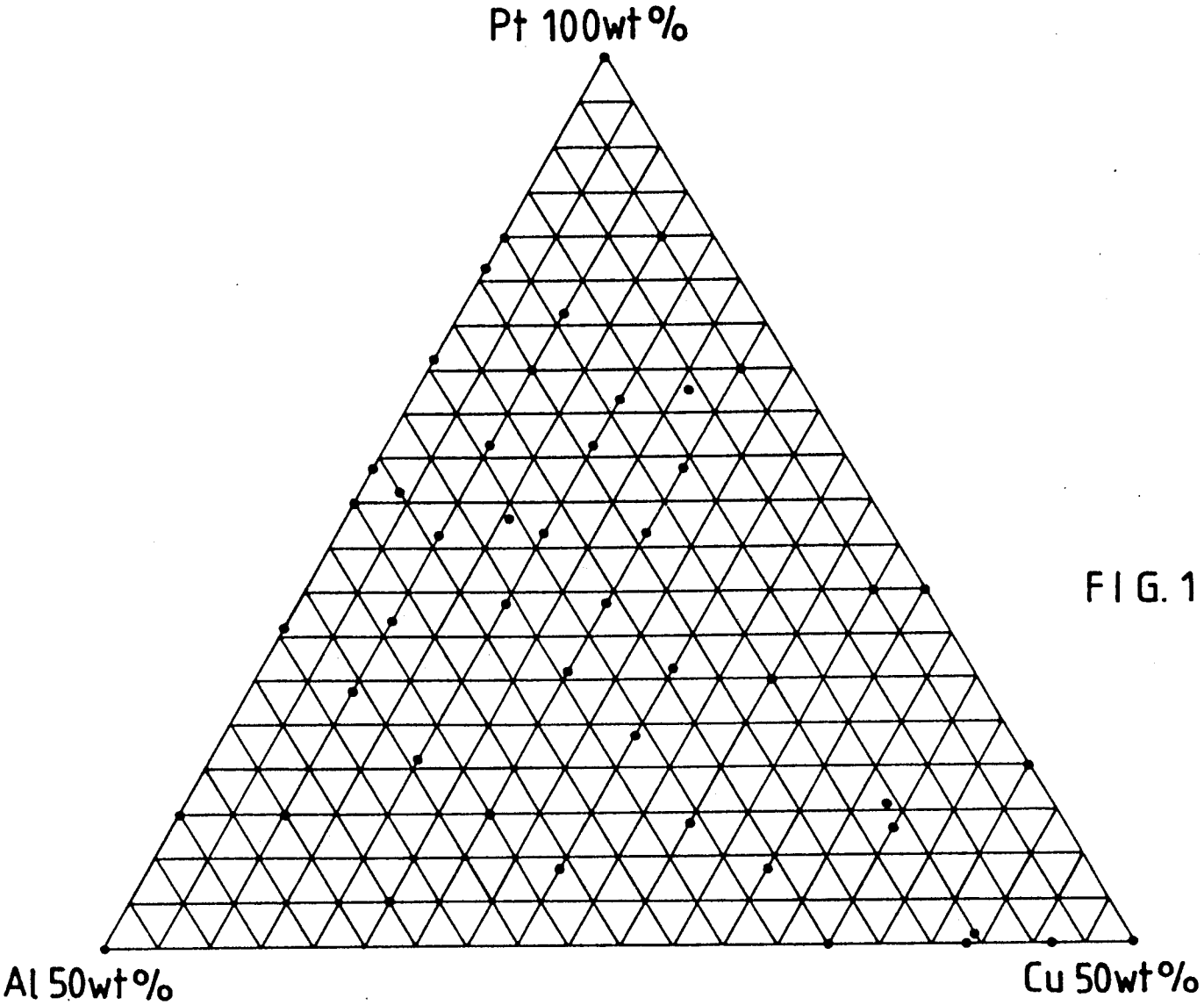
FIG. 1 is a three component triangular graphical diagram illustrating the various compositions of intermetallic compounds tested.

In the experimental intermetallic compounds produced either various amounts of copper were added to $PtAl_2$ (in respect of compound numbers 5 to 14 in Table 1) or the required amounts of the three constituent metals were simply weighed out separately (in respect of compound numbers 15 onwards in Table 1); the mixture was melted in an arc furnace under an argon atmosphere and the resultant intermetallic compound allowed to solidify.

The following compositions were made, in amongst others, the compositions being given in Table 1 together with their colour measurement results on a Spectrogard Colour Spectro-photometer, which are further described below:

TABLE 1

| COMPOUND No. | | COMPOSITION BY WEIGHT % Pt | % Al | % Cu | x | y | L* | a* | b* | % Colour | Colour |
|---|---|---|---|---|---|---|---|---|---|---|---|
| 1 | Platinum | 100 | | | 0.32 | 0.32 | 89.12 | −0.13 | −0.54 | 4.12 | |
| 2 | PtAl | 87.8 | 12.2 | | 0.32 | 0.32 | 82.93 | 1.86 | 2.28 | 3.58 | |
| 3 | Pt2A13 | 83 | 17 | | 0.31 | 0.32 | 78.34 | −1.41 | 1.93 | 2.57 | |
| 4 | PtA12 | 77 | 23 | | 0.35 | 0.35 | 83.91 | 0.67 | 17.71 | 20.14 | Yellow |
| 5 | PtA12 + 2% Cu | 75.5 | 22.5 | 2 | 0.34 | 0.35 | 80.45 | 0.43 | 14.45 | 17.13 | Yellow |
| 6 | PtA12 + 5% Cu | 73.2 | 21.8 | 5 | 0.37 | 0.37 | 79.05 | 0.56 | 26.85 | 31.45 | Yellow |
| 7 | PtA12 + 6% Cu | 72.4 | 21.6 | 6 | 0.37 | 0.37 | 78.71 | 2.26 | 24.08 | 28.72 | Yellow |
| 8 | PtA12 + 7% Cu | 71.6 | 21.4 | 7 | 0.36 | 0.36 | 79.50 | 1.93 | 22.17 | 26.32 | Yellow |
| 9 | PtA12 + 8% Cu | 70.8 | 21.2 | 8 | 0.36 | 0.36 | 79.70 | 2.42 | 20.98 | 25.04 | Yellow |
| 10 | PtA12 + 9% Cu | 70.1 | 20.9 | 9 | 0.36 | 0.36 | 79.90 | 2.61 | 22.12 | 26.30 | orange/yellow |
| 11 | PtA12 + 10% Cu | 69.3 | 20.7 | 10 | 0.36 | 0.36 | 79.06 | 4.07 | 22.02 | 26.69 | orange |
| 12 | PtA12 + 15% Cu | 65.5 | 19.5 | 15 | 0.36 | 0.34 | 75.33 | 10.07 | 13.62 | 19.08 | orange/red |
| 13 | PtA12 + 20% Cu | 61.6 | 18.4 | 20 | 0.34 | 0.33 | 75.70 | 7.89 | 9.25 | 13.41 | copper/red |
| 14 | PtA12 + 25% Cu | 57.8 | 17.2 | 25 | 0.34 | 0.33 | 77.44 | 7.63 | 7.76 | 11.38 | copper/red |
| 19 | | 54 | 16 | 30 | 0.34 | 0.33 | 78.87 | 5.37 | 8.20 | 11.25 | orange |
| 20 | | 50 | 15 | 35 | 0.34 | 0.34 | 73.75 | 5.01 | 9.94 | 13.89 | orange |
| 22 | | 77 | 8 | 15 | 0.32 | 0.33 | 76.32 | 0.35 | 4.22 | 5.74 | pale yellow/orange |
| 24 | | 81 | 9 | 10 | 0.32 | 0.32 | 66.88 | 0.66 | 3.62 | 5.61 | pale yellow/orange |
| 26 | | 78 | 12 | 10 | 0.31 | 0.32 | 75.17 | 0.04 | 2.07 | 3.15 | pale yellow |
| 27 | | 74 | 11 | 15 | 0.32 | 0.32 | 77.45 | −0.90 | 3.37 | 4.41 | pale yellow |
| 28 | | 65 | 10 | 25 | 0.32 | 0.33 | 78.91 | −0.38 | 4.23 | 5.42 | pale yellow/orange |
| 29 | | 56.5 | 8.5 | 35 | 0.32 | 0.33 | 76.37 | −0.10 | 4.42 | 5.85 | fairly pale yellow/orange |
| 30 | | 50.5 | 7.5 | 42 | 0.32 | 0.33 | 81.81 | 0.44 | 4.63 | 5.93 | pale pink/orange |
| 31 | | 78 | 17 | 5 | 0.32 | 0.33 | 75.07 | −0.15 | 4.34 | 6.09 | pale yellow |
| 32 | | 74 | 16 | 10 | 0.33 | 0.33 | 76.50 | 0.77 | 6.40 | 8.38 | pale yellow/orange |
| 33 | | 69.5 | 15.5 | 15 | 0.33 | 0.33 | 76.09 | 2.81 | 7.22 | 9.87 | orange/yellow |
| 34 | | 65.5 | 14.5 | 20 | 0.32 | 0.32 | 78.75 | 0.30 | 3.72 | 4.99 | orange/yellow |
| 36 | | 61 | 29 | 10 | 0.33 | 0.33 | 73.81 | 3.46 | 5.46 | 7.98 | fairly pale orange/pink |
| 37 | | 57.5 | 27.5 | 15 | 0.33 | 0.33 | 71.85 | 4.02 | 6.65 | 9.87 | orange/pink |
| 38 | | 54.5 | 25.5 | 20 | 0.33 | 0.33 | 73.13 | 3.75 | 7.12 | 10.24 | orange/pink |
| 39 | | 69 | 26 | 5 | 0.33 | 0.33 | 74.14 | 2.90 | 6.38 | 9.04 | orange/yellow |
| 45 | | 70 | 2.5 | 27.5 | 0.32 | 0.32 | 76.68 | −0.22 | 2.55 | 3.61 | pale yellow |
| 46 | | 50 | 8 | 42 | 0.33 | 0.33 | 81.52 | 0.47 | 7.70 | 9.37 | pale yellow |
| 47 | | 50 | 4 | 46 | 0.33 | 0.33 | 82.29 | 1.67 | 7.92 | 9.82 | pale yellow/orange |
| 48 | | 50 | 8 | 42 | 0.32 | 0.33 | 81.43 | 0.81 | 6.54 | 8.17 | pale yellow/orange |
| 49 | | 50 | 4 | 46 | 0.33 | 0.33 | 80.10 | 0.86 | 7.37 | 9.21 | pale yellow/orange |
| 50 | | 58 | 8 | 34 | 0.32 | 0.33 | 81.18 | 0.05 | 4.87 | 6.14 | pale yellow |
| 51 | | 50 | 4 | 46 | 0.33 | 0.33 | 79.11 | 1.72 | 8.95 | 11.31 | pale yellow/orange |
| 52 | | 58 | 8 | 34 | 0.32 | 0.33 | 79.81 | −0.19 | 4.51 | 5.77 | pale yellow |

The above intermetallic compounds had the colours stated which proved to be aesthetically pleasing and suitable for providing a novel appearance to components of articles of jewellery. Compounds numbers 1 to 4, which fall outside of the scope of this invention, and which form part of the prior art, were made for comparison purposes.

The intermetallic compound samples were prepared in a button arc furnace under an argon atmosphere.

Samples were mounted and polished to a lum mirror finish for colour measurements. FIG. 1 shows the sample compositions used for further measurements.

Figure 3:
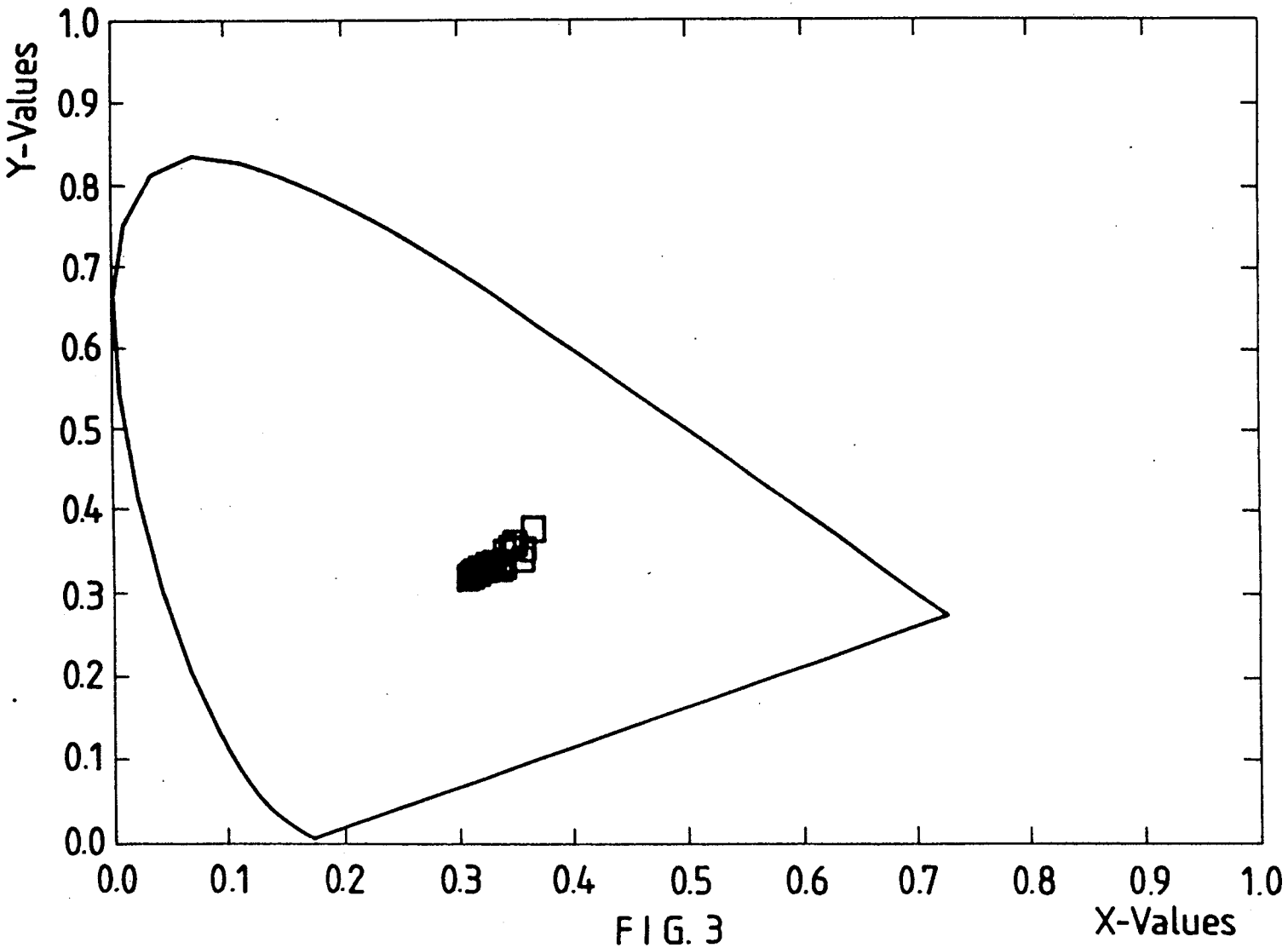
FIG. 3 is a plotted colour locus of "x" and "y" values of chromaticity measurements for preferred coloured samples.
Figure 4:
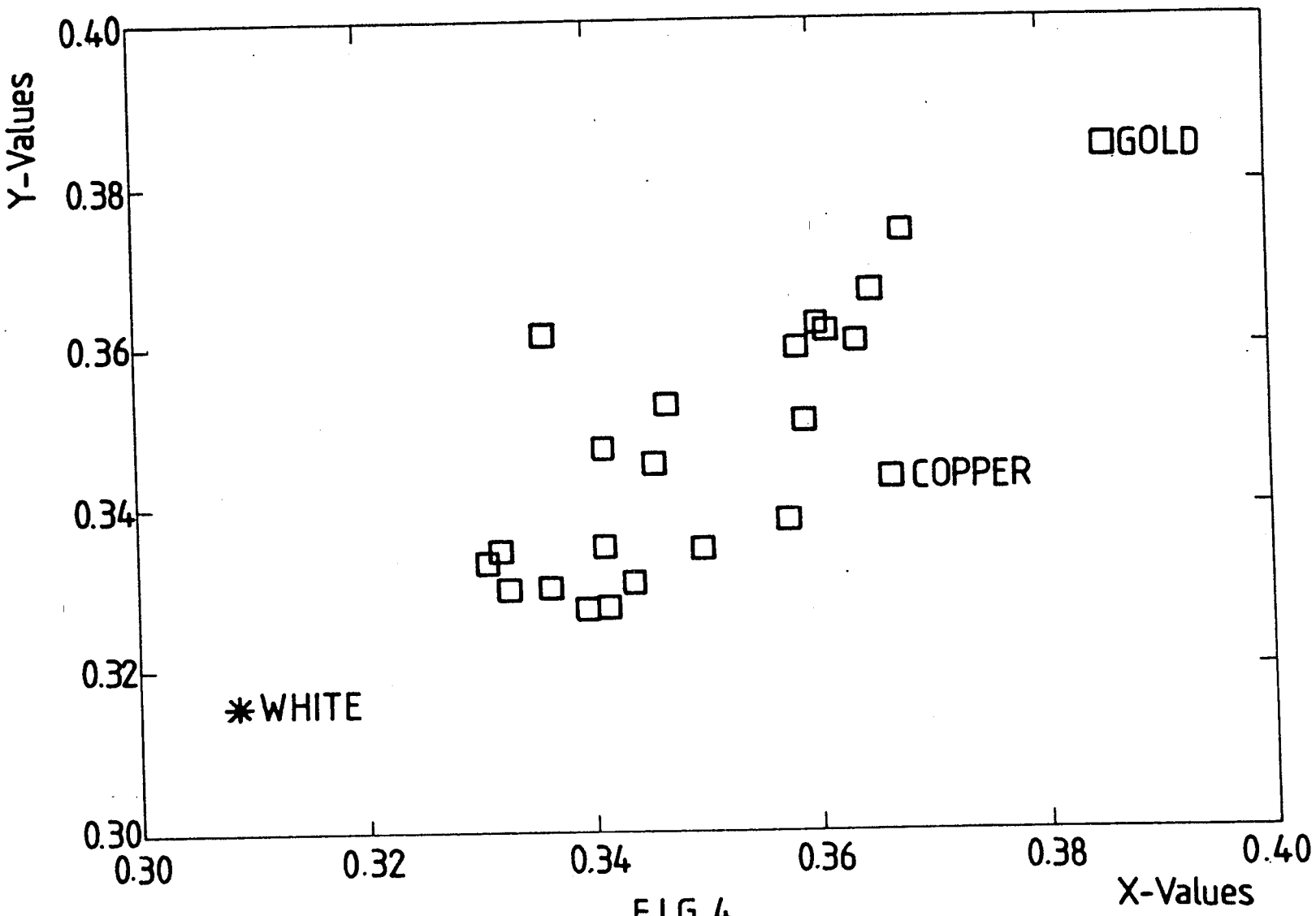
FIG. 4 is an enlargement of part of the colour locus showing the points of high colour saturation.

Colour measurements were made using Spectrogard Colour Spectro-photometer. A standard CIE source C illuminent was used (average daylight). A CIE observer angle of 2° was used for all calculations. Both the Yxy (chromaticity) and CIElab colour scales were calculated from the measured data. The chromaticity data is plotted on a colour locus in FIG. 3. FIG. 4 shows an enlargement of the colour locus showing the points of relatively high colour saturation relative to white, pure gold and copper. The % colour saturation values are given in Table 1.

Figure 5:
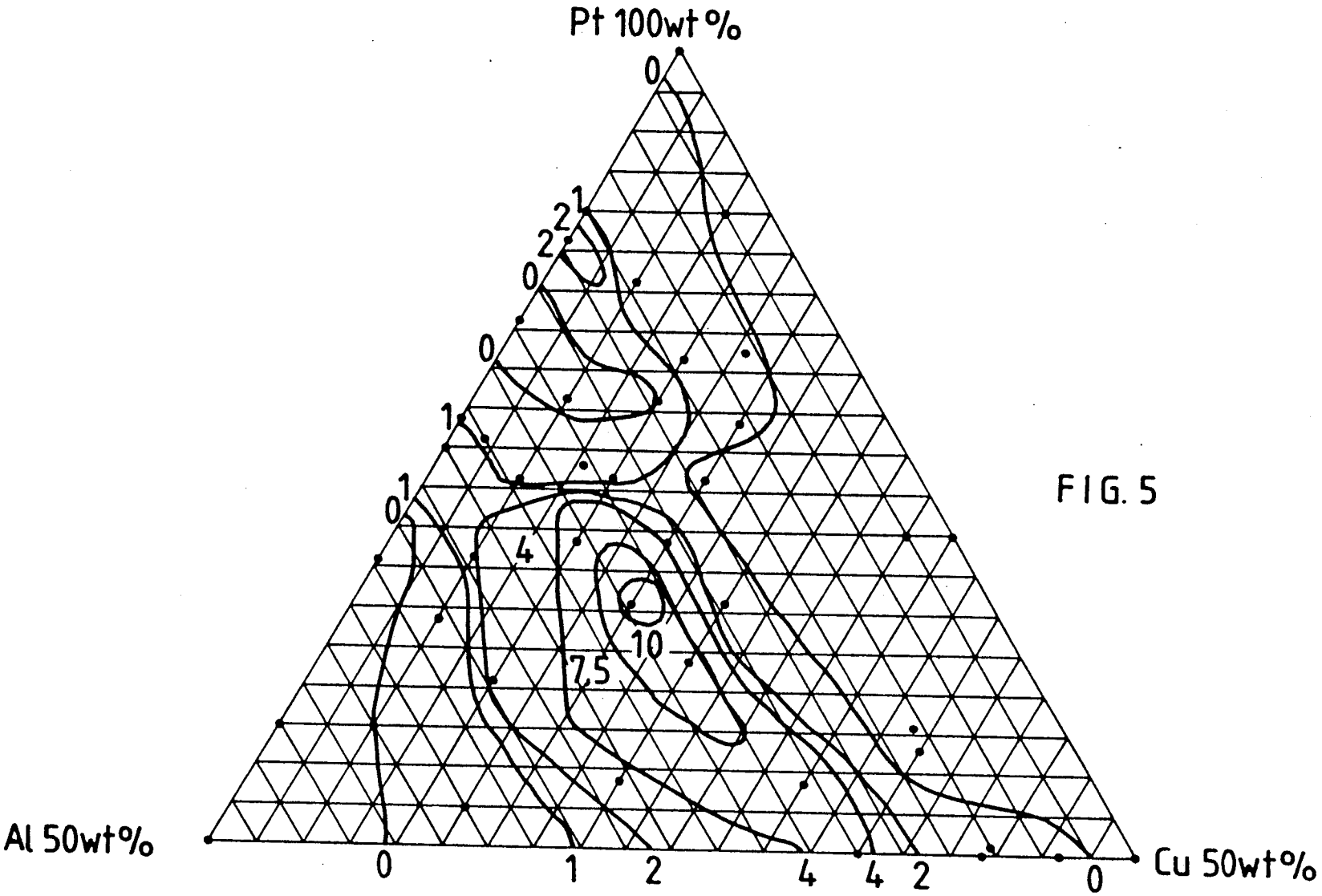
FIG. 5 and 6 show a* and b* values respectively of the CIElab colour scales for the samples measured; and, FIG. 7 is a hardness-composition triangle showing the Vickers micro-hardness values of the various intermetallic compositions tested.
Figure 6:
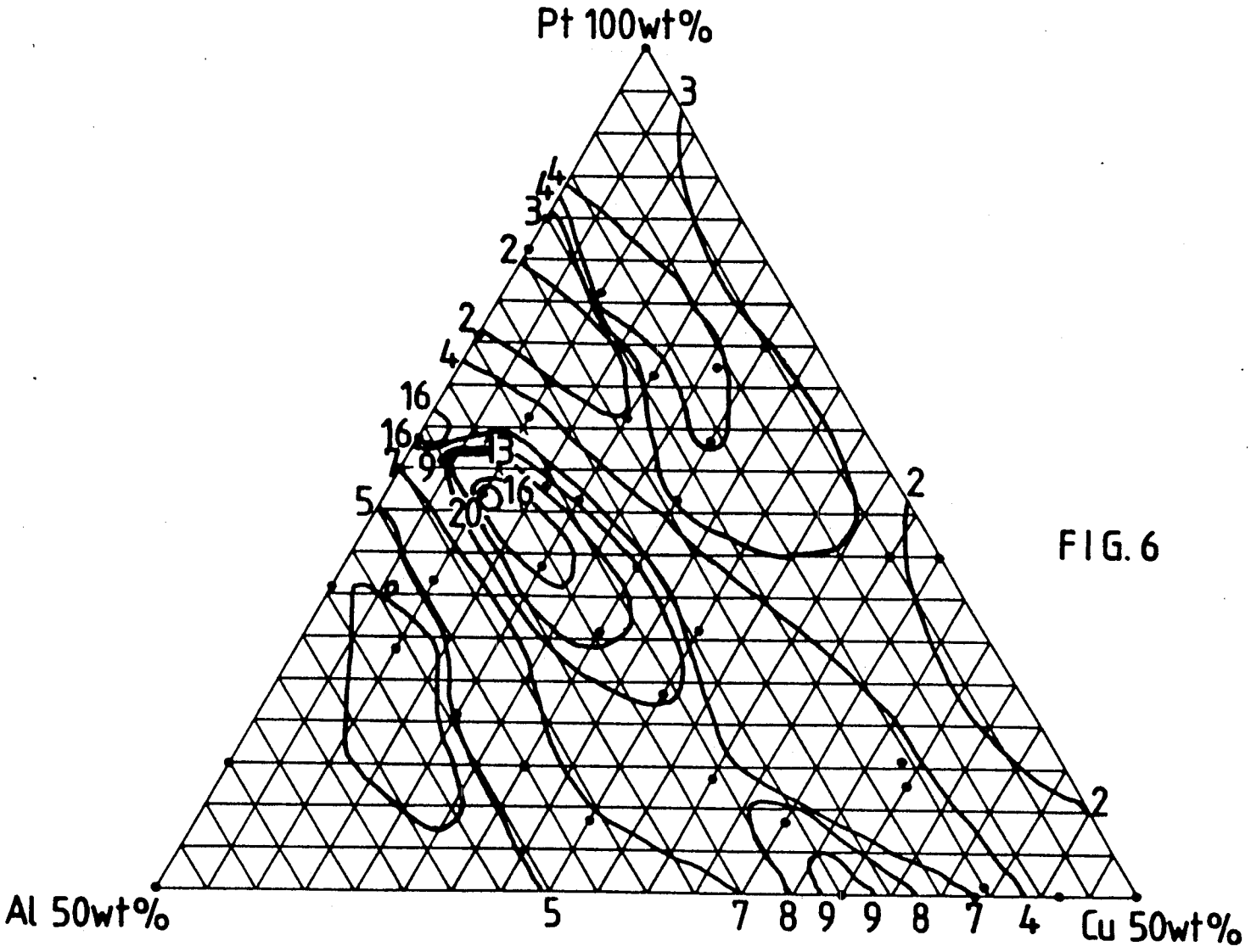

The CIElab data is plotted in FIGS. 5 and 6. This data defines composition areas having high colour coordinates. The a* values plotted in FIG. 5 give a measure of the red and green colour component of a sample. Increasing positive a* values indicate an increasing red component and a negative a* value indicates an increasing green component. The b* values plotted in FIG. 6 give a measure of the yellow and blue colour components. Increasing positive b* indicate an increasing yellow component and negative b* values indicate the blue component. By mapping out the a* and b* values as a function of composition, it enables one to exactly match a desired colour by choosing the corresponding composition.

From these colour-composition triangles, it is clear that the composition range having the highest colour saturation is:

Pt 81 wt. % to 50 wt. %

Al 30 wt. % to 5 wt. %

Cu 47.5 wt. % to 1 wt. %

Compositions outside of these limits do have colour but of low saturation and it is therefore difficult to observe the difference in colour, relative to platinum, with the human eye.

Figure 7:
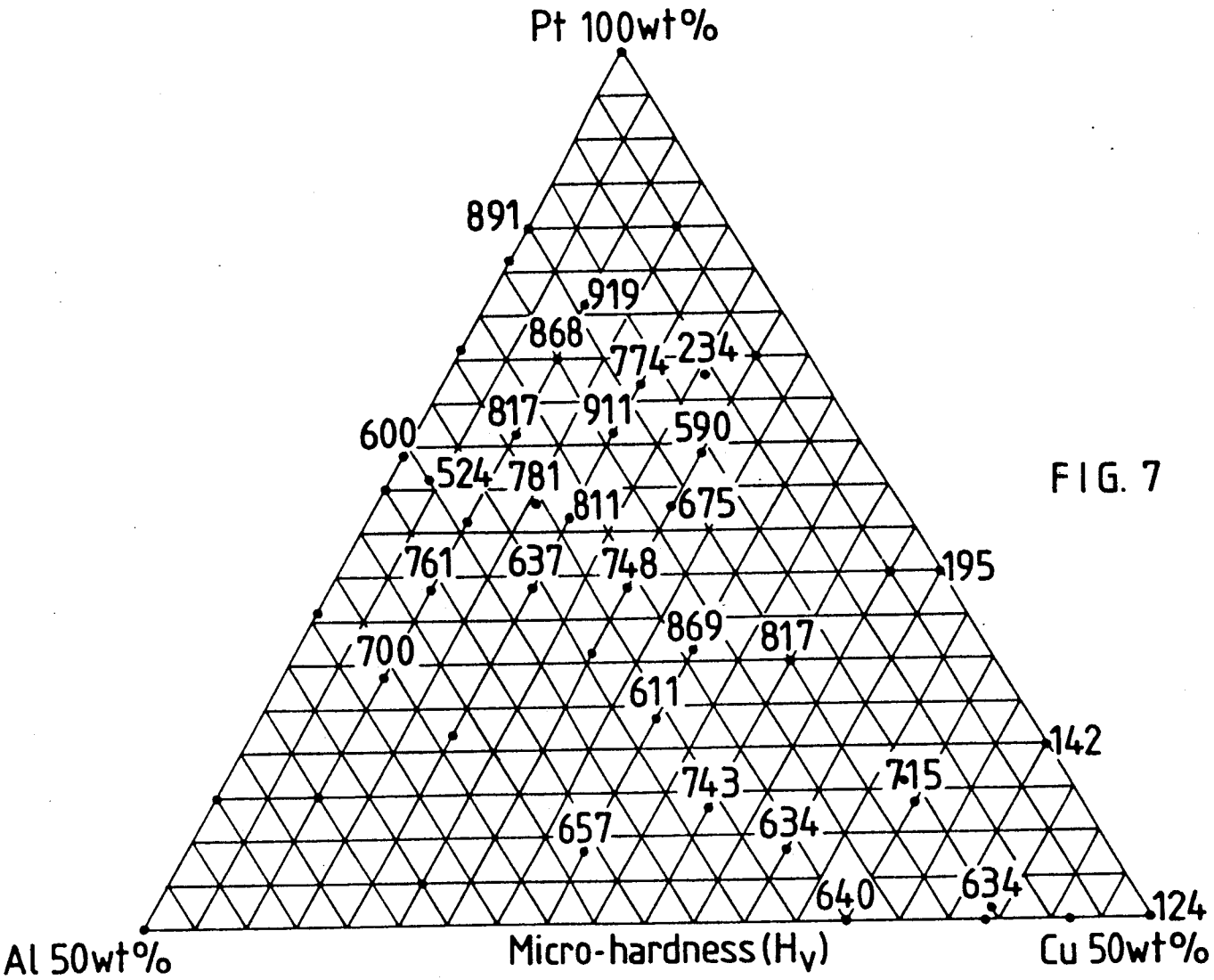

Intermatallic compounds are known to be hard and brittle as is found with the platinum-aluminium intermetallic compounds. The addition of copper to the intermetallic compounds has no notable effect on the hardness of platinum-aluminium intermetallics. There is, however, a large decrease in the Vickers Micro-hardness values when no, or very little, aluminium is present in platinum-copper alloys. Vickers hardness values as low as 124 Hv were measured in the as-cast state of platinum-copper alloys. The hardness values measured are given on a hardness-composition triangle in FIG. 7.

The melting point of the intermetallic compounds having a high colour saturation, as determined from Table 1, have been determined. Dual thermal analysis was carried out on all of these samples and the melting point was calculated from the onset temperature of the endothermic peak. Table 2 gives the melting point measured for 10 intermetallic compounds. It is evident that the addition of copper to the $PtAl_2$ intermetallic compounds causes a large decease in melting point. This is very advantageous to manufacturing jewellers who will be able to work with the material using standard jewellery equipment.

TABLE 2

| COMPOUND NO | MELTING POINT °C. |
|---|---|
| 4 | 1413.5 |
| 5 | 1324.3 |
| 6 | 1406.2 |
| 11 | 1380.0 |
| 12 | 1352.4 |
| 13 | 1335.3 |
| 14 | 1287.7 |
| 20 | 1210.2 |
| 51 | 1121.3 |
| 19 | 1179.4 |

It is envisaged that the compounds of the invention could be used for making, amongst other articles, cabochons and facetted pieces. It is also envisaged that the intermetallic compounds may be cast to form rings or other articles which can be made by a casting process as the compounds are not ductile and therefore not particularly workable. However facets can easily be formed on bodies of the intermetallic compounds.

Based on the above results, it is envisaged that various interesting colours can be produced with the colour compositions in the range indicated above.

Figure 2:
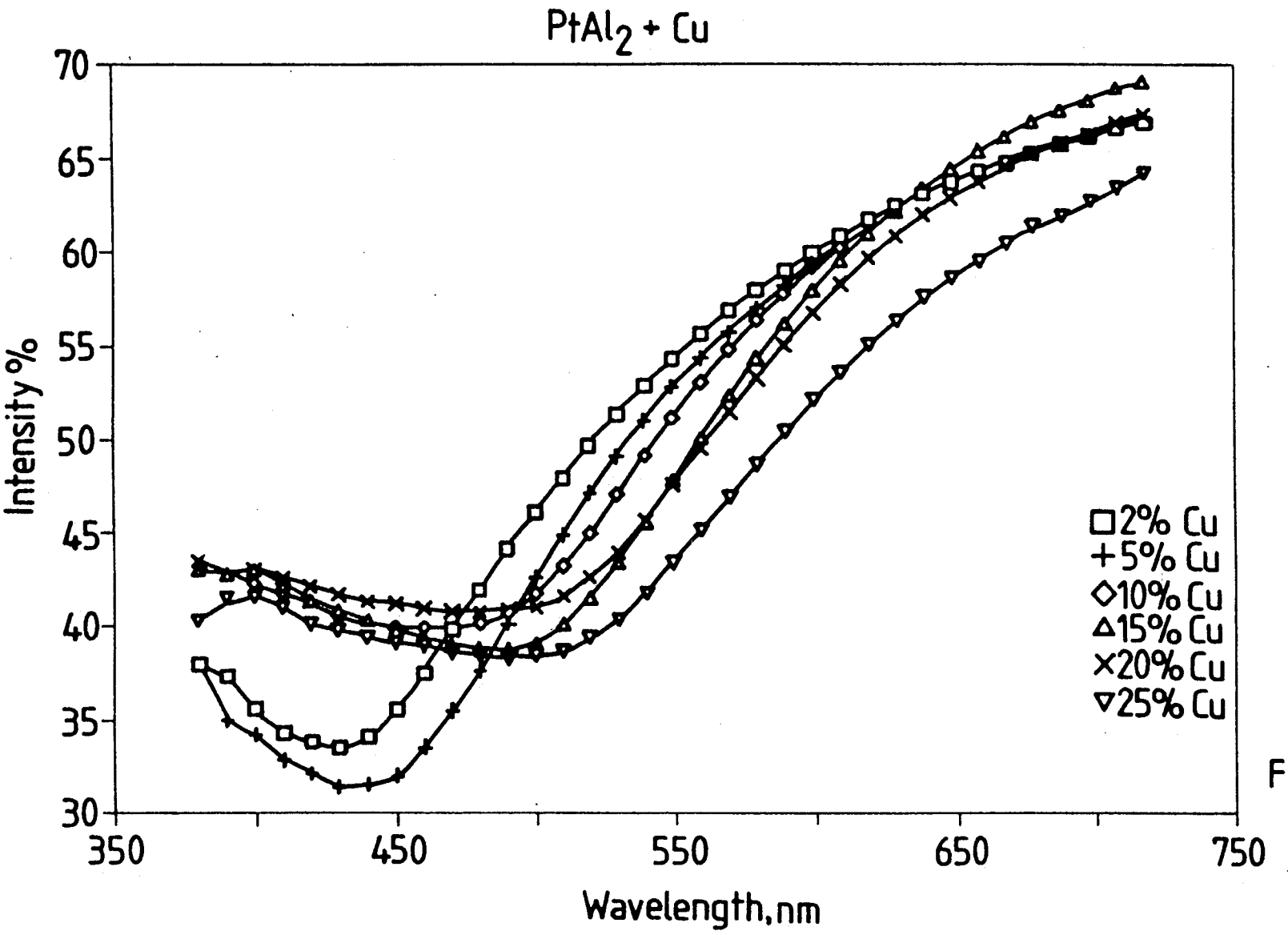
FIG. 2 is a graphical illustration of the reflectivity of the compounds produced for the range of visible wavelengths illustrating the colour modification that has taken place.

The actual change in light reflectivity has been measured and the results are illustrated in FIG. 2.

Accordingly the invention provides intermetallic compounds of platinum and aluminium with modified colours brought about by th addition of various quantities of copper to the compound and which, it is envisaged, will be highly useful in the jewellery trade.

What we claim as new and desire to secure by Letters Patent is:

1. An intermetallic compound of platinum and aluminium comprising:

i) from 50 to 81 weight per cent platinum;

ii) from 5 to 30 weight per cent of aluminium; and, iii) from 1 to 47.5 weight per cent copper.

2. An intermetallic compound as claimed in claim 1 and comprising:

i) from 57 to 80 per cent by weight: platinum;

ii) from 12.5 to 30 per cent by weight aluminium; and, iii) from 5 to 30 per cent by weight copper

3. An intermetallic compound as claimed in claim 1 and which is of yellow colour and has the composition of:

i) 70 to 77 % by weight platinum ii) 20 to 23 % by weight aluminium; and, iii) 1 to 8 % by weight copper.

4. An intermetallic compound as claimed in claim 1 and which is of orange colour and has the composition of:

i) 63 to 70 % by weight platinum ii) 18 to 21 % by weight aluminium and, iii) 8 to 15 % by weight copper.

5. An intermetallic compound as claimed in claim 1 which is of copper-red colour and has the composition of:

i) 54 to 62 % by weight platinum ii) 15 to 20 % by weight aluminium; and, iii) 20 to 30 % by weight copper.

6. An intermetallic compound as claimed claim 1 and wherein its chromaticity (Yxy), when measured using a standard CIE source C illuminent, and a standard observer angle of 2., has an "x" value and a "y" value in respect of intermetallic compound samples polished to a 1μm mirror finish, that provide a percentage colour of at least 9,8.

7. An intermetallic compound as claimed in claim 6 in which the "x" value is at least 0.34 and the "y" value is at least 0.33.

8. An intermetallic compound as claimed in claim 1 in which the compound is made by adding copper in the appropriate quantity to a preformed intermetallic compound $PtAl_2$.

9. An intermetallic compound as claimed in claim 1 in which the compound is made by melting components together under an inert atmosphere.

* * * * *

UNITED STATES PATENT AND TRADEMARK OFFICE

CERTIFICATE OF CORRECTION

PATENT NO. : 5,045,280

DATED : September 3, 1991

INVENTOR(S) : Janice Hurly

It is certified that error appears in the above-identified patent and that said Letters Patent is hereby corrected as shown below:

On the title page, Item [73] Assignee, after "Mintek" insert --; Western Platinum Limited--.

Signed and Sealed this

Sixth Day of April, 1993

*Attest:*

STEPHEN G. KUNIN

*Attesting Officer*

*Acting Commissioner of Patents and Trademarks*